US007118361B2

(12) United States Patent
Patterson

(10) Patent No.: US 7,118,361 B2
(45) Date of Patent: Oct. 10, 2006

(54) ROTARY PISTONS

(75) Inventor: Albert W. Patterson, West Lorne (CA)

(73) Assignee: 1564330 Ontario Inc., Ontario (CA)

( * ) Notice: Subject to any disclaimer, the term of this patent is extended or adjusted under 35 U.S.C. 154(b) by 211 days.

(21) Appl. No.: 10/845,171

(22) Filed: May 14, 2004

(65) Prior Publication Data

US 2005/0254983 A1 Nov. 17, 2005

(51) Int. Cl.
*F01C 1/00* (2006.01)

(52) U.S. Cl. ..... 418/268; 418/260

(58) Field of Classification Search ..... 418/259, 418/260, 266, 267, 268, 140, 146, 206.1; 74/412 R See application file for complete search history.

(56) References Cited

U.S. PATENT DOCUMENTS 1,745,800 A * 2/1930 Kramer ..... 417/85
3,312,387 A * 4/1967 Cassidy et al. ..... 418/88
3,797,975 A * 3/1974 Keller ..... 418/137
4,154,208 A * 5/1979 Kunieda et al. ..... 123/236
4,418,663 A * 12/1983 Bentley ..... 123/243
4,772,187 A * 9/1988 Thompson ..... 418/46
4,917,584 A 4/1990 Sakamaki et al.
5,092,752 A * 3/1992 Hansen ..... 418/137
6,554,596 B1 * 4/2003 Patterson et al. ..... 418/260
6,799,549 B1 * 10/2004 Patterson et al. ..... 123/204
6,945,218 B1 * 9/2005 Patterson ..... 123/264

FOREIGN PATENT DOCUMENTS

JP 57-32095 2/1982

OTHER PUBLICATIONS

Mechanical Engineering Design; Joseph E. Shigley, Charles R. Mischke, Richard G. Budynas; 2004; McGrawHill; Seventh Edition; pp. 664-665.*

* cited by examiner

*Primary Examiner*—Hoang Nguyen
(74) *Attorney, Agent, or Firm*—Nixon Peabody LLP; Jeffrey L. Costellia

(57) ABSTRACT

A rotary piston for use in pumps or motors, the piston having a radially movable vanes seated within the pumps rotor. The vanes are biased outwardly and forced inwardly by a cam action of the interior wall of the housing of the piston. Operation of the piston may be facilitated by the use of peripherally mounted drive gears. The rotary piston according to the present invention is particularly useful in pumping fluids and provides a system that can operate at both high and low speeds for a wide range of liquid viscosities.

10 Claims, 4 Drawing Sheets

ROTARY PISTONS

FIELD OF THE INVENTION

The present invention relates to improved rotary pistons for use in pumps or motors.

BACKGROUND OF THE INVENTION

Rotary pistons, in the nature of encased rotors with radially extending vanes which move in and out of the rotors, depending upon their location within the casing used, for example, as pumps or turbines, are known. One such device is described in U.S. Pat. No. 6,554,596 of Albert and David Patterson issued Apr. 29, 2003, in which the vane movement, in and out of the rotor, is achieved by cam surfaces within the casing which act on both inner and outer edges of the vanes.

In my co-pending U.S. patent application Ser. No. 10/680,236 entitled rotary pistons, the outward movement of the vanes is achieved by upward extensions of shoulders at the sides of each vane, which upward extensions contain pins which are seated in races continuously extending in portions of the interior side wall of the casing and positioned so that as the pins move about the races, they draw their respective vanes outwardly.

Other known constructions of such vane "motors" require centrifugal force, through rotation of the rotor, to force the vanes out.

Problems with such arrangements, if applied to hydraulics, include leakage of fluid between the vanes and consequent inability to effectively and efficiently handle fluids under high pressure. Of necessity, such devices have conventionally been of relatively small size, and, while they have been able to operate at fast speeds, they have been able to move only relatively low volumes of fluid.

It is an object of the present invention to provide a hydraulic pump for liquid or air which will operate efficiently and effectively at medium or high pressures and handle high fluid volumes and high torque at low, medium or high fluid pressure. It is also an object of the present invention to provide a simpler construction of rotary piston which provides for outward vane movement, from the rotor, at lower rotor speeds and without the need for cam surfaces or races within the casing, thereby providing a simpler and more economical construction for rotary pistons.

SUMMARY OF THE INVENTION

In accordance with the present invention there is provided a rotary piston which comprises a shaft to rotate about a longitudinal axis, and a rotor centrally secured to the shaft. The rotor has ends and a cylindrical side wall. A rotor disk is secured at each end of the rotor to rotate with the rotor. A housing encases the rotor and has interior end walls confronting the rotor ends and an interior side wall opposite the rotor end wall. Fluid inlet and fluid outlet ports are located in the housing side wall. A first portion of the interior side wall of the housing is cylindrical and curved with constant radius over an angle of approximately 180°. This portion is spaced a constant distance from corresponding portions of the side wall of the rotor. A second cylindrical portion of the interior side wall of the housing extends between the extremities of the first portion of the interior side wall and is of curvature of greater radius. The wall of the rotor meets the interior side wall of the housing at a point between inlet and outlet ports about midway on the second portion. The inlet and outlet ports are spaced from each other in the second portion of the interior side wall of the housing. Two or more planar vanes extend from end to end in the rotor and have inner and outer edges extending parallel to the axis of the rotor. Each vane is movable in slots in the rotor radially inwardly and outwardly between retracted and extended positions with respect to the cylindrical side wall of the rotor. The vanes have side shoulders which slide in corresponding guide slots in the rotor disks. The outer edges of the vanes are positioned adjacent to the interior side wall of the housing. The housing side wall exerts a cam action on these outer edges. The vanes are equally spaced from adjacent vanes about the rotor such that there is always at least one vane positioned between inlet and outlet ports. Biasing means are provided to urge each of the vanes radially within its associated slot towards extended position, so that during operation, the outer edge of each vane is constantly positioned adjacent a corresponding portion of the interior side wall of the housing. The rotor, housing and vanes are constructed so that, during operation of the pump, fluid entering the housing is carried by the rotor in compartments formed between adjacent vanes, the rotor side wall between those vanes, the rotor disks and the interior side wall of the housing, until the adjacent vanes encompass the outlet port whereby the fluid is allowed to escape.

In a preferred embodiment of the present invention a rotary piston where two or more spaced pins are secured within each rotor slot. Each pin extends radially in its slot. Corresponding pockets are provided in the inner edge of corresponding vanes to slidably receive the pins. A spring is seated within each pocket to bear against the corresponding pin in a manner so as to provide the biasing of the vanes.

As well, in another preferred embodiment of the present invention, the outer edge of each vane is convexly rounded and extends outwardly beyond planar faces of the vane, between the shoulders, to form a linear, mushroom-shaped head of the vane. The rotor slot for each corresponding vane has a corresponding enlargement for receiving the vane's head such that the outer edge is housed within that groove when the vane is in retracted position.

The device according to the present invention, while providing many of the same advantages of applicant's previously developed rotary pistons, is simpler and more economical to construct, since the outer vane movement does not require end cams or races to activate and guide that movement. The present invention has a wide range of applications, including pumps, compressors and motors. The rotary piston according to the present invention is particularly effective in pumping fluids with higher viscosities.

BRIEF DESCRIPTION OF THE DRAWINGS

These and other advantages of the invention will become apparent upon reading the following detailed description and upon referring to the drawings in which.

Figure 1:
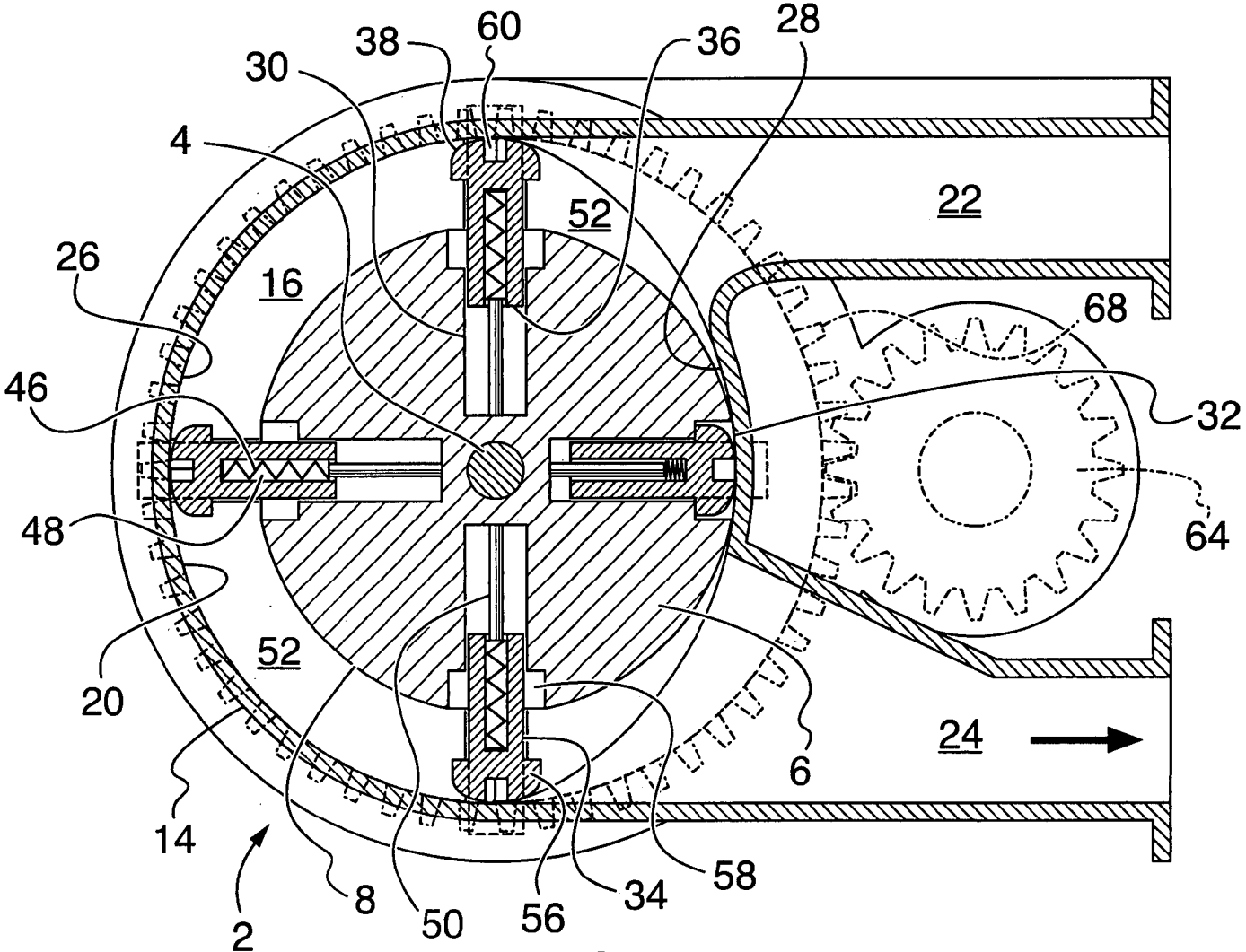
FIG. 1 is a schematic side section view of an example embodiment of rotary piston according to the present invention.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

Turning to FIG. 1, there is illustrated a rotary piston 2 in accordance with the present invention. The piston comprises a shaft 4 rotating about a longitudinal axis, on which shaft a rotor 6 is centrally secured. Rotor 6 has a body with a cylindrical side wall 8 extending between spaced ends 10. A rotor disk 12 is provided at each end of rotor 6, each disk secured at its center to shaft 4 and to the corresponding end 10 of rotor 6. Shaft 4, rotor 6, and rotor disks 12 may be of integral construction. It is preferred that the diameter of disks 12 be greater than that of rotor 6.

Figure 3:
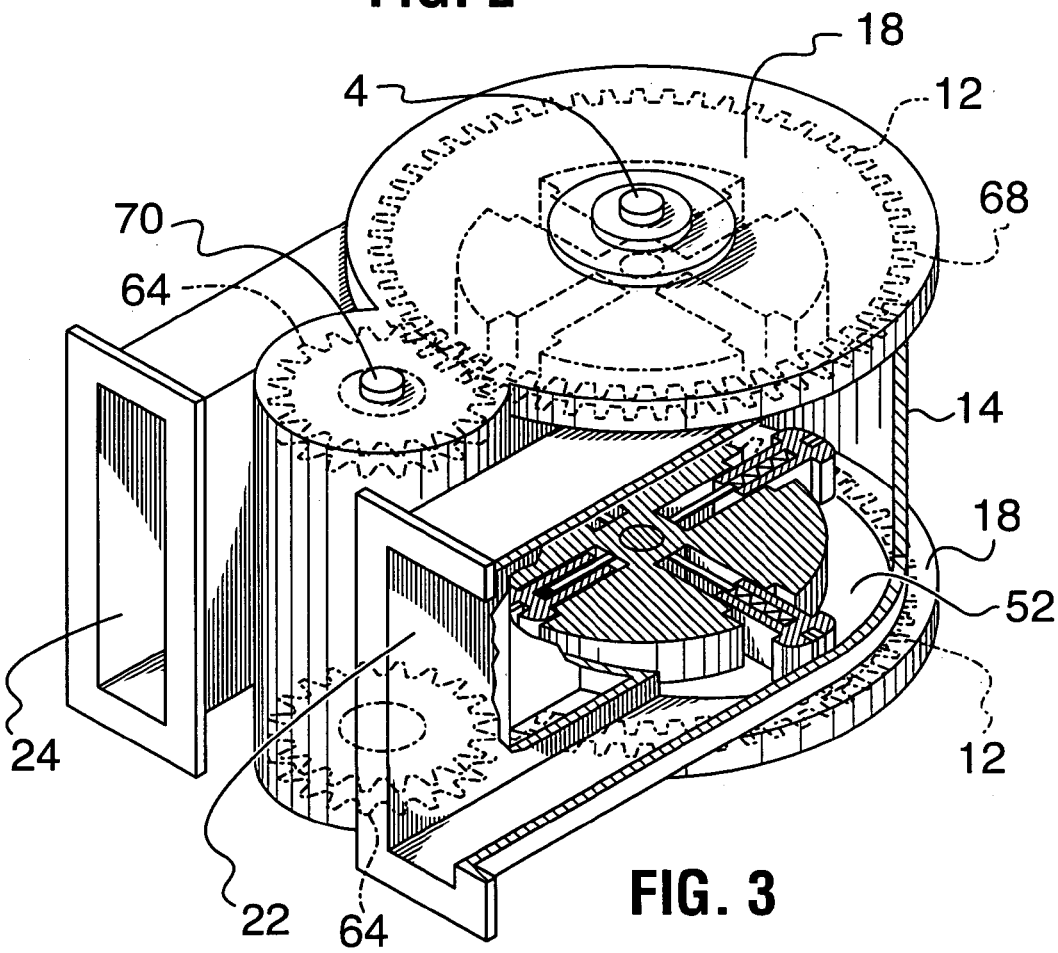
FIG. 3 is a perspective view, in partial section, of the rotary piston of FIG. 1.
Figure 5:
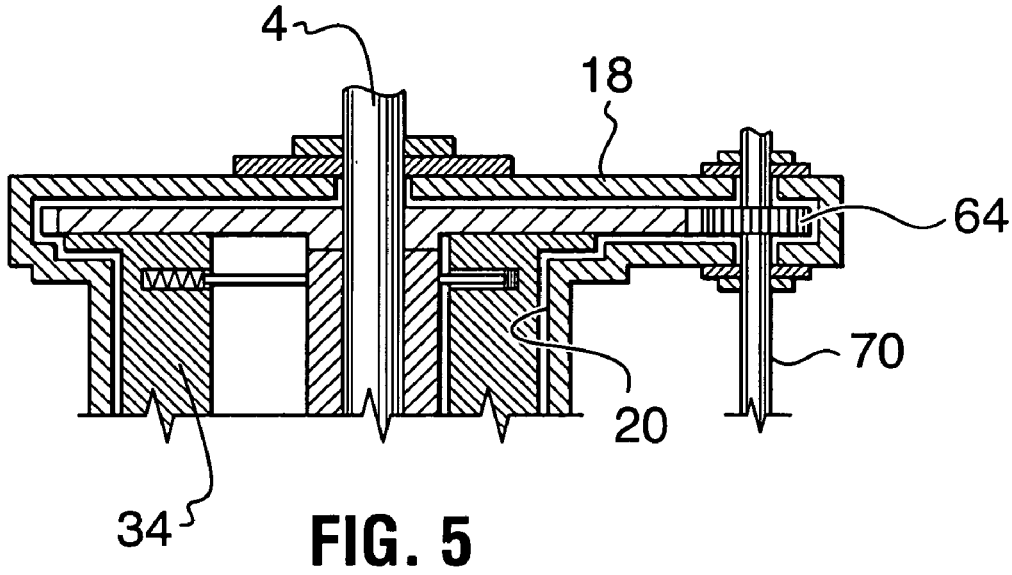
FIG. 5 is a partial view, in section, of an upper portion of the rotary piston of FIG. 3.

A housing 14 encases rotor 6 and rotor disks 12 within an internal cavity 16. Shaft 4 extends outside housing 14, as illustrated (FIGS. 3 and 5). Housing 14 has end walls 18 adjacent to rotor disks 12 and an interior side wall 20. Fluid inlet port 22 and fluid outlet port 24 are provided in side wall 20.

As can be seen in FIG. 1, first portion 26 of the interior sidewall 20 is cylindrical and curved with constant radius over an angle of about 180°. This portion is spaced a constant distance from corresponding portions of the cylindrical side wall 8 of rotor 6. A second cylindrical portion 28 of the interior side wall 20 extends between the extremities of this first portion 26 of the interior side wall. Portion 28 has a curvature of greater radius than that of the first portion.

Two or more (four are illustrated) equally spaced, radially oriented slots 30 in rotor 6 extend end to end across its cylindrical side wall 8. This cylindrical side wall 8 is proximal to the interior sidewall 20 of the housing at a point 32 on portion 28, about midway between the inlet and outlet ports 22 and 24. Inlet and outlet ports 22 and 24 are located in this second portion 28.

Two or more (again, four are illustrated) similar vanes 34 are slidably seated in the slots 30 of rotor 6 as illustrated. Each vane 34 has an inner edge 36 and an outer edge 38 extending between sides 40 of the vanes. Each vane 34 is movable radially in its corresponding slot between an extended position with the outer edge 38 of the vane adjacent first portion 26 of the interior sidewall of the housing and a retracted position, when the vane passes point 32, where that outer edge 38 is retracted and does not extend beyond the cylindrical surface of side wall 8 of the rotor. The vanes 34 are spaced from each other about the rotor such that there is always at least one vane positioned between the inlet and outlet ports 22 and 24. Sides 40 of vanes act as shoulders 42 which slide in corresponding guide slots 44 in the rotor disks 12. As can be seen in FIG. 1, outer edges 38 of vanes 34 are always positioned adjacent interior side wall 20 of housing 14, this side wall 20 exerting a cam action on those outer edges, to move the vanes to retracted position. Vanes 34 are spaced equally from adjacent vanes 34, about rotor 6, and are located so that there is always at least one vane positioned between inlet port 22 and outlet port 24.

In order to ensure outward movement of vanes 34 and the biasing of those vanes so that they are always in contact with corresponding portions of inner side wall 20 of housing 14, springs 46 are provided. These springs are held in pockets 48 which extend upwardly, as illustrated, from the internal edge 36 of each vane 34. Two or more such springs 46 and pockets 48 are located in spaced fashion, as illustrated, in each vane 34. Secured to the bottom of each slot 30 in rotor 6, and positioned so as to be mateably received in vane pockets 48, are pins 50. Springs 46 are held within pockets 48 by these pins 50, and bear against the pins and the bottoms of the respective pockets so as to provide appropriate upward bias to the vanes in their corresponding rotor slots 30. During operation, the outer edge 38 of each vane 34 is constantly positioned against a corresponding portion of the interior side wall 20 of housing 14. The rotor 6, housing 14 and vanes 34 are constructed so that, during operation of the rotary piston, fluid entering housing 14 is carried by rotor 6 in compartments 52 formed between adjacent vanes 34, rotor cylindrical side wall 8 between those vanes, the rotor disks 12 and the corresponding portions of the interior side wall 20 of housing 14, until these adjacent vanes encompass the outlet port 24, at which point fluid in that compartment 52 is allowed to escape through outlet port 24.

Figure 2:
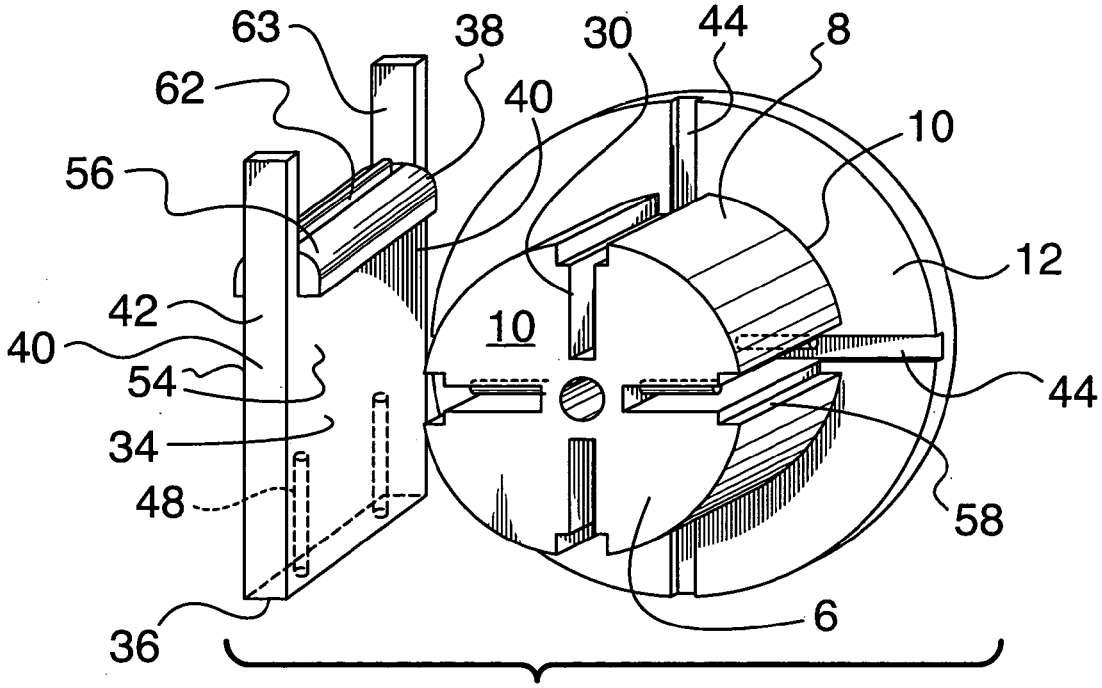
FIG. 2 is a partial, perspective view of a rotor, and disk and (exploded) vane of the rotary piston of FIG. 1.

As can be seen in FIGS. 1 and 2, outer edge 38 of each vane is convexly rounded and extends outwardly beyond planar faces 54, on each side of the vane, between shoulders 42, to form, as illustrated, a linear, mushroom-shaped head 56 of the vane. The cylindrical side wall 8 of rotor 6 has a corresponding enlargement 58 formed such that, when outer edge 38 of the vane is in retracted position, head 56 is housed within that enlargement 58, beneath the cylindrical side wall of rotor 6. As well, an elongated slot 60 (FIG. 1) extends from side to side, as illustrated, in each head 56, and a seal 62 (FIG. 2) is seated in that slot, the seal restricting the leakage of fluid between adjacent compartments 52 during operation of the pump. As illustrated, for example, in FIGS. 2 and 5, it is preferred that shoulders 42 have extensions 63 going beyond head 56. These extending portions of the shoulders in fact extend outwardly beyond inner side wall 20 of housing 14 sliding in slots 44 in rotor disks 12 and assist in restricting leakage of fluid from chambers 52 during operation of the device.

Figure 4:
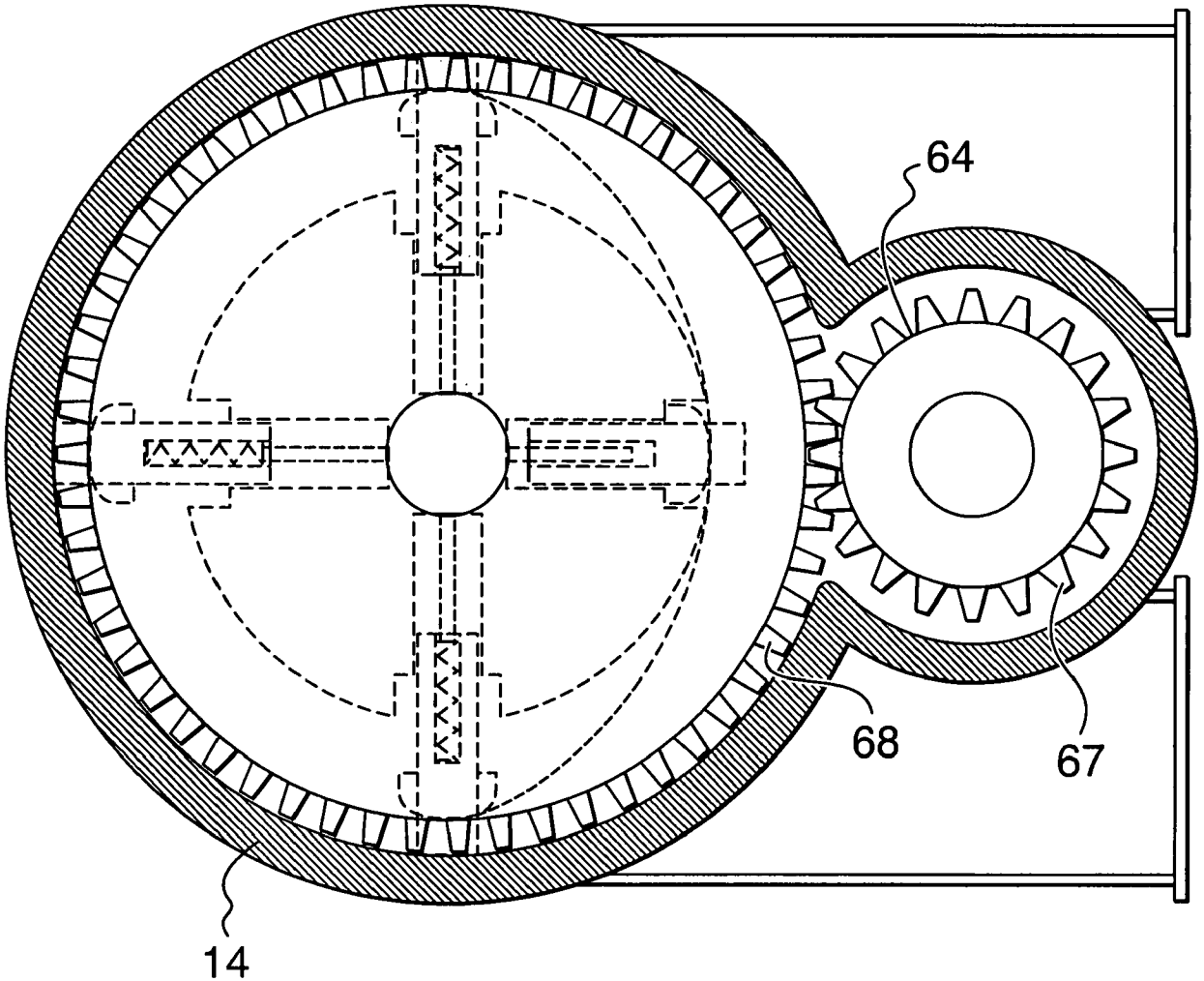
FIG. 4 is a side section view of the rotary piston of FIG. 1, in partial phantom, illustrating a gear drive mechanism for the piston.
Figure 6:
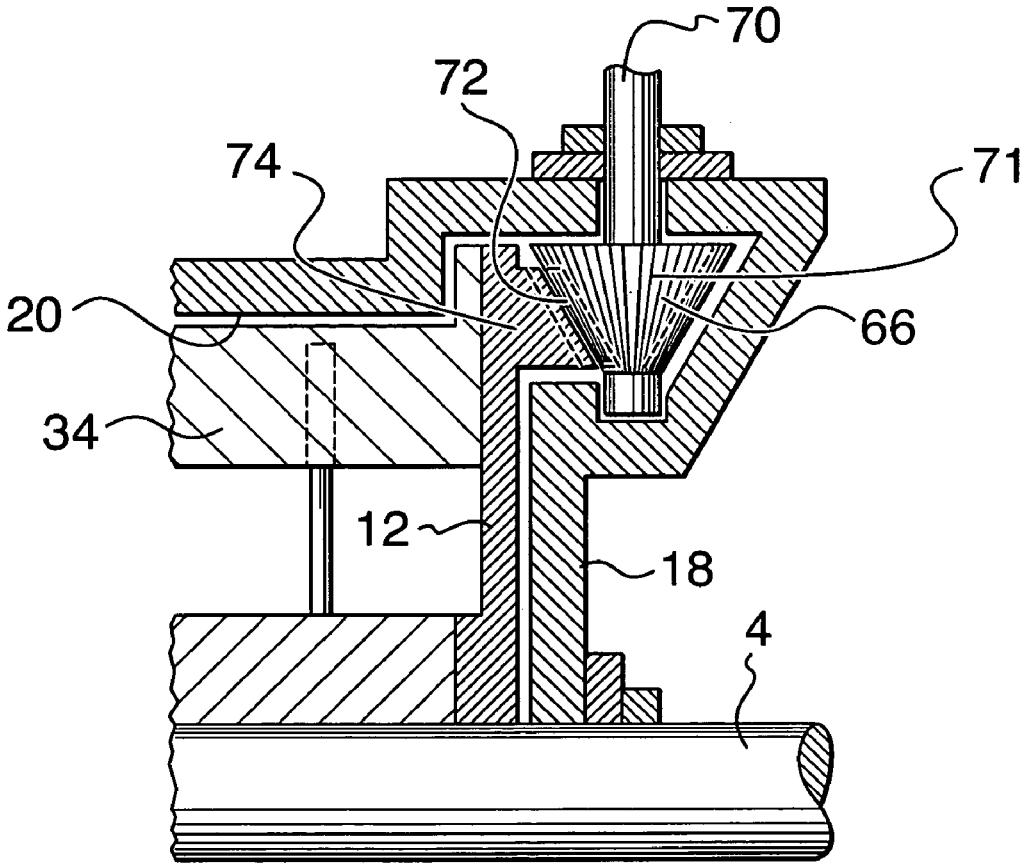
FIG. 6 is a partial view, again in section, of upper portion of an alternative embodiment of rotary piston in accordance with the present invention.

To facilitate functioning of the rotary pump in accordance with the present invention, as illustrated particularly in FIGS. 5 and 6, either a regular drive gear 64 (FIGS. 4 and 5) or a bevel gear 66 (FIG. 6) may be associated with a peripheral portion of one or both of the rotor disks 12. As can be seen in FIGS. 4 and 5, teeth 67 of drive gear 64 drive teeth 68 which have been formed on the outside circumference of rotor disk 12. Gear 64 is preferably positioned between inlet and outlet ports 22 and 24, as illustrated. As illustrated in FIG. 3, a pair of drive gears 64 may be provided, one running on gear teeth 68 on each of the rotor disks 12, off a common shaft 70 in this embodiment. Larger diameter end disks 12 than otherwise would be required, are needed to provide adequate clearance for the operation of drive gear 64.

In the alternative embodiment illustrated in FIG. 6, the teeth 71 of bevel gear 66 mesh with gear teeth 72 on annular projection 74 about the periphery of rotor disk 12, that projection facing housing end wall 18 as illustrated. This embodiment does not require such a large diameter rotor disk 12. Again it is preferred that bevel gear 66 be located between inlet and outlet ports 22 and 24.

The drive gear system as described allows the rotor to be driven by a high speed motor while keeping the rotor rpm's lower, resulting in an increased torque being applied to movement of fluids by the rotor vanes 34.

The rotary piston according to the present invention is particularly useful in pumping fluids and provides a system that can operate at both high and low speeds, for a wide range of liquid viscosities and even gases.

Thus, it is apparent that there has been provided in accordance with the invention a rotary piston device that fully satisfies the objects, aims and advantages set forth above. While the invention has been described in conjunction with illustrated embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. A rotary piston comprising:

a shaft to rotate about a longitudinal axis;

a rotor centrally secured to the shaft, the rotor having ends and a cylindrical side wall;

a rotor disk at each end of the rotor to rotate with the rotor;

a housing encasing the rotor, the housing having interior end walls confronting the rotor ends and an interior side wall opposite the rotor side wall, with fluid inlet and fluid outlet ports in the housing side wall, a first portion of the interior side wall of the housing being cylindrical and curved with constant radius over an angle of approximately 180°, this portion being spaced a constant distance from corresponding portions of the side wall of the rotor, a second cylindrical portion of the interior side wall of the housing continuing from extremities of the first portion of the interior side wall and being of curvature of greater radius, the wall of the rotor meeting the interior side wall of the housing at a point between inlet and outlet ports about midway on the second portion, the inlet and outlet ports being spaced from each other in this second portion of the interior side wall of the housing;

two or more planar vanes extending from end to end in the rotor and having inner and outer edges extending parallel to the axis of the rotor, each vane movable in slots in the rotor radially inwardly and outwardly between retracted and extended positions with respect to the cylindrical side wall of the rotor, the vanes having side shoulders which slide in corresponding guide slots in the rotor disks, with outer ends positioned always in contact with the interior side wall of the housing, which side wall exerts a cam action on these outer ends, the vanes being equally spaced from adjacent vanes about the rotor and located on the rotor such that there is always at least one vane positioned between inlet and outlet ports;

biasing means to urge each of the vanes radially within its associated slot towards extended position, so that during operation, the outer end of each vane is constantly positioned in contact with a corresponding portion of the interior side wall of the housing;

the rotor, housing and vanes constructed so that, during operation of the pump, fluid entering the housing is carried by the rotor in compartments formed between adjacent vanes, the rotor side wall between those vanes, the rotor disks and the interior side wall of the housing, until the adjacent vanes encompass the outlet port whereby the fluid is allowed to escape.

2. A rotary piston according to claim 1, wherein the biasing means comprises a spring acting on each vane to urge it towards extended position.

3. A rotary piston according to claim 1, wherein two or more spaced pins are secured within each rotor slot, each pin extending radially in its slot, and corresponding pockets are provided in the inner edge of corresponding vanes to slidably receive the pins, a spring being seated within each pocket to bear against the corresponding pin in a manner so as to provide the biasing of the vanes.

4. A rotary piston according to claim 3, wherein the outer edge of each vane is convexly rounded and extends outwardly beyond planar faces of the vane, between the shoulders, to form a linear, mushroom-shaped head of the vane, the rotor slots for each corresponding vane having a corresponding enlargement such that the outer end is housed within that enlargement for receiving the vane's head when the vane is in retracted position.

5. A rotary piston according to claim 4, wherein an elongated slot is provided in each head and a seal is seated in that slot to restrict the leakage of fluid between adjacent compartments during operation of the piston.

6. A rotary piston according to claim 1, wherein the rotor disks extend beyond the rotor surface and at least one rotor disk has a peripheral edge provided with regular gear teeth formed therein, and an aligned drive gear is provided with teeth mateably interacting with the end disk gear teeth.

7. A rotary piston according to claim 6, wherein the drive gear is positioned between the inlet and outlet ports proximal the second portion of the interior side wall of the housing.

8. A rotary piston according to claim 1, wherein peripheral portions of at least one of the rotor disks is provided with regular gear teeth on a peripheral surface facing the corresponding end wall of the housing and a bevel gear is provided with teeth mateably interacting with the end disk gear teeth.

9. A rotary piston according to claim 8, wherein the drive gear is positioned between the inlet and outlet ports proximal the second portion of the interior side wall of the housing.

10. A rotary piston according to claim 1 provided with four of said planar vanes.

* * * * *